US010190819B2

(12) United States Patent
Falta et al.

(10) Patent No.: US 10,190,819 B2
(45) Date of Patent: Jan. 29, 2019

(54) ARGON CONDENSATION SYSTEM AND METHOD

(71) Applicants: Steven R. Falta, Honeoye Falls, NY (US); Brian S. Powell, Williamsville, NY (US); Henry E. Howard, Grand Island, NY (US); Vijayaraghavan S. Chakravarthy, Williamsville, NY (US); Maulik R. Shelat, Williamsville, NY (US)

(72) Inventors: Steven R. Falta, Honeoye Falls, NY (US); Brian S. Powell, Williamsville, NY (US); Henry E. Howard, Grand Island, NY (US); Vijayaraghavan S. Chakravarthy, Williamsville, NY (US); Maulik R. Shelat, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

(21) Appl. No.: 16/032,243

(22) Filed: Jul. 11, 2018

(65) Prior Publication Data

US 2018/0320962 A1 Nov. 8, 2018

Related U.S. Application Data

(62) Division of application No. 14/754,786, filed on Jun. 30, 2015.

(Continued)

(51) Int. Cl.
*F25J 3/04* (2006.01)
*F25J 3/02* (2006.01)

(52) U.S. Cl.
CPC ..... *F25J 3/04672* (2013.01); *F25J 3/0285* (2013.01); *F25J 3/048* (2013.01);
(Continued)

(58) Field of Classification Search
CPC .... F25J 3/0285; F25J 3/04678; F25J 3/04703; F25J 3/048
See application file for complete search history.

(56) References Cited

U.S. PATENT DOCUMENTS 3,167,113 A 1/1965 Kleiss
4,276,125 A 6/1981 Issei
(Continued)

FOREIGN PATENT DOCUMENTS

EP 0 860 670 A2 8/1998
EP 1 108 965 A1 6/2001
(Continued)

*Primary Examiner* — Tareq Alosh
(74) *Attorney, Agent, or Firm* — Robert J. Hampsch

(57) ABSTRACT

An argon reflux condensation system and method in which a plurality of once-through heat exchangers are connected to an argon column of an air separation plant to condense argon-rich vapor streams for production of reflux to the argon column. Condensation of the argon-rich vapor streams is brought about through indirect heat exchange with crude liquid oxygen streams that partially vaporize and are introduced into a lower pressure column of the plant for further refinement. The flow rate of the crude liquid oxygen streams are sensed and controlled at locations in the plant where the crude liquid oxygen is in a liquid state and in proportion to the size of the once-through heat exchangers. Feed stream flow rate to the argon column is controlled in response to air flow rate to the plant and product flow rate is controlled in response to the feed stream flow rate to the argon column.

7 Claims, 2 Drawing Sheets

Related U.S. Application Data

(60) Provisional application No. 62/020,075, filed on Jul. 2, 2014.

(52) U.S. Cl.
CPC ..... *F25J 3/04412* (2013.01); *F25J 3/04678* (2013.01); *F25J 3/04715* (2013.01); *F25J 3/04848* (2013.01); *F25J 2250/02* (2013.01); *F25J 2250/20* (2013.01)

(56) References Cited

U.S. PATENT DOCUMENTS

| | | | |
|---|---|---|---|
| 4,670,031 | A | 6/1987 | Erickson |
| 4,756,731 | A | 7/1988 | Erickson |
| 4,790,866 | A | 12/1988 | Rathbone |
| 4,822,395 | A | 4/1989 | Cheung |
| 5,114,449 | A | 5/1992 | Agrawal et al. |
| 5,122,174 | A | 6/1992 | Sunder et al. |
| 5,255,522 | A | 10/1993 | Agrawal et al. |
| 5,546,766 | A | 8/1996 | Higginbotham |
| 5,916,261 | A | 6/1999 | Bonaquist et al. |
| 5,956,973 | A | 9/1999 | Herron et al. |
| 6,393,866 | B1 | 5/2002 | Srinivasan et al. |
| 6,397,632 | B1 | 6/2002 | Meagher |
| 7,134,297 | B2 | 11/2006 | Corduan et al. |
| 9,291,389 | B2 | 3/2016 | Kibler et al. |
| 2006/0016215 | A1 | 1/2006 | Tonkovich et al. |
| 2006/0283208 | A1 | 12/2006 | Chakravarthy et al. |
| 2012/0131951 | A1 | 5/2012 | Myobatake |
| 2016/0370111 | A1 | 12/2016 | Alekseev |

FOREIGN PATENT DOCUMENTS

| | | | |
|---|---|---|---|
| EP | 1 336 805 | A1 | 8/2003 |
| JP | H07 133982 | A | 5/1995 |
| JP | 2004-163003 | A | 6/2004 |
| JP | 2006-266532 | A | 10/2006 |

ARGON CONDENSATION SYSTEM AND METHOD

CROSS REFERENCE TO RELATED APPLICATIONS

The present application claims the benefit of and priority to U.S. patent application Ser. No. 14/754,786 filed on Jun. 30, 2015, which claims the benefit of and priority to U.S. provisional patent application Ser. No. 62/020,075 filed on Jul. 2, 2014.

FIELD OF THE INVENTION

The present invention relates to an argon condensation system and method for condensing argon-rich vapor column overhead of an argon column of an air separation unit to produce reflux for the argon column and liquid argon product. More particularly, the present invention relates to such a system and method in which the argon-rich vapor column overhead is condensed in a plurality of once-through heat exchangers through indirect heat exchange with a crude liquid oxygen column bottoms produced in a higher pressure column of the air separation unit. Even more particularly, the present invention relates to such a system and method in which liquid flow rates of the crude liquid oxygen column bottoms are controlled.

BACKGROUND

Argon is typically produced through the cryogenic rectification of the air conducted in an air separation unit. The air separation unit consists of compressors to compress the air, a purification to purify the air by removal of higher boiling impurities, a main heat exchanger to cool the air and a distillation column system to rectify the compressed, purified and cooled air and thereby produce an argon product.

The distillation column system can be provided with a double column unit having a higher pressure column and a lower pressure column operatively associated in a heat transfer relationship by a condenser reboiler. The higher pressure column, so designated because it operates at a higher pressure than the lower pressure column, distills the incoming air to produce a nitrogen-rich vapor column overhead and a crude liquid oxygen column bottoms also known as kettle liquid. A stream of the crude liquid oxygen column bottoms is in turn further refined in the lower pressure column to produce an oxygen-rich liquid column bottoms and a nitrogen-rich vapor column overhead. Oxygen-rich and nitrogen-rich product streams can be heated in the main heat exchanger to help cool the incoming compressed and purified air. An argon and oxygen containing vapor stream, removed from the lower pressure column near at a point of maximum argon concentration, serves as a crude argon feed stream to an argon column to separate the argon from the oxygen and thereby to produce an argon-rich vapor column overhead. A heat exchanger is connected to the argon column to condense a stream of the argon-rich vapor column overhead to produce reflux to the argon column and a liquid argon product. Depending upon the number of stages of separation contained in the argon column, the liquid argon product may be directly taken or further refined as necessary with a catalytic unit to remove oxygen and another distillation column to separate out the nitrogen contained in the argon.

Typically, the heat exchanger used in condensing the argon-rich vapor column overhead is a thermosiphon type of heat exchanger in which a heat exchange core is situated within a shell. The crude liquid oxygen is introduced into the shell and is partially vaporized through indirect heat exchange with the argon-rich vapor passing through condensation passages of the heat exchange core. The argon-rich vapor is condensed and residual liquid within the shell due to the partial vaporization of the crude liquid oxygen is drawn through open vaporization passages of heat exchange core through the thermosiphon effect. The vapor and liquid phases can be separately introduced into the lower pressure column for further refinement of the crude liquid oxygen. An oxygen containing column bottoms produced in the argon column as a result of the separation of argon and oxygen is also returned to the lower pressure column. When a single core does not have the necessary surface area, a series of cores can be positioned within the shell.

A more cost effective method of condensing argon-rich vapor is to use once-through heat exchangers in which the crude liquid oxygen and argon-rich vapor are separately introduced into adjacent boiling and condensation passages. While this type of arrangement uses less components than a thermosiphon arrangement, where the heat exchange duty needs to be divided into two or more heat exchangers, dry out becomes a significant problem because high boiling temperature hydrocarbon components can freeze out and concentrate leading to flammability hazards. This problem arises because the heat exchangers are sited at a sufficiently high level as compared to the higher pressure column that the loss of head results in the flashing of the liquid into vapor and therefore, control of the flow to ensure that sufficient crude liquid oxygen is introduced into each of the heat exchangers is problematical.

SUMMARY OF THE INVENTION

The present invention provides an argon reflux condensation system for an air separation unit having an argon column, a lower pressure column and a higher pressure column. The argon reflux condensation system comprises a plurality of once-through heat exchangers connected to an argon column such that argon-rich vapor streams composed of argon-rich vapor column overhead are condensed within condensation passages of the once-through heat exchangers to produce an argon-rich liquid product stream and argon-rich liquid reflux stream returned to the argon column as reflux. The argon-rich vapor column overhead is produced through distillation of a crude argon feed stream fed from the lower pressure column to the argon column. Crude oxygen feed conduits connected between the higher pressure column and vaporization passages of the once-through heat exchangers such that a plurality of crude liquid oxygen streams composed of a crude liquid oxygen column bottoms of the higher pressure column are partially vaporized in the vaporization passages of the once-through heat exchangers through indirect heat exchange with the argon-rich vapor streams to produce partially vaporized crude liquid oxygen streams introduced into the lower pressure column. Crude liquid oxygen flow transducers are positioned within the crude liquid oxygen feed conduits at locations where the crude liquid oxygen streams are in a liquid state to sense liquid flow rates of the crude liquid oxygen streams. The crude liquid oxygen flow transducers are configured to produce flow signals, each referable to a liquid flow rate within a crude liquid oxygen feed conduit associated therewith. Crude oxygen flow control valves are positioned within the crude liquid oxygen feed conduits downstream of the flow transducers to control the liquid flow rates and crude liquid oxygen flow controllers, responsive to the flow signals, are configured to control the flow control valves such that the flow rates of the crude liquid oxygen streams are controlled to attain flow rate set points proportional to vaporization surface areas provided by the vaporization passages of each of the one-through heat exchangers. One or more control subsystems are provided for controlling a feed stream flow rate of the crude argon feed stream in response to air flow rate into the air separation unit and for controlling a product flow rate of the argon-rich liquid product stream in response to the feed stream flow rate of the crude argon feed stream.

As mentioned above, the flow rate set points are proportional to the vaporization surface areas. And what is meant by this is not that the proportion is exact in that the flow rate set points might be biased to account for unforeseen variation in the flow to the once-through heat exchangers due to heat leakage and piping defects. However, the vaporization surface areas of the once-through heat exchangers can be of equal size. In such case, the flow would at least be divided equally, with perhaps slight variations between the two flows.

Preferably, a level transducer is connected to the higher pressure column to sense a level of the crude liquid oxygen column bottoms in the higher pressure column and to generate a level signal referable to the level of the crude liquid oxygen column bottoms. A level controller, responsive to the level signal, is configured to generate the flow rate set points such that the flow rate set points decrease as the level of the crude liquid oxygen bottoms decreases and vice-versa and the level is maintained at a constant height within the higher pressure column. Additionally, temperature transducers can be positioned to sense temperatures of the partially vaporized crude liquid oxygen streams that are indicative of quality of the partially vaporized crude liquid oxygen streams. In such case, the control subsystem for controlling the feed stream flow rate is responsive to the temperature transducers such that feed stream flow rate and product flow rate decreases when the temperatures of the partially vaporized crude liquid oxygen streams are above a predetermined level indicative of dry out within the vaporization passages. Additionally, the crude liquid oxygen flow controllers can also be responsive to the temperature transducers such that when the temperatures are unequal, the flow rate set points are biased so as to maintain the temperatures at an equal level.

The feed stream flow rate control subsystem can preferably comprise a reflux control valve positioned between the condensation passages of the once-through heat exchangers and the argon column to control a reflux flow rate of the argon-rich liquid reflux stream. A feed flow transducer is connected to the crude argon feed conduit to sense the feed stream flow rate of the crude argon feed stream and configured to produce a crude argon signal referable to the feed stream flow rate and a crude argon flow controller is provided that is responsive to the crude argon signal and a feed stream set point. The feed stream set point being a function of the air flow rate into the air separation unit multiplied by a crude fraction. The crude argon flow controller is configured to control the argon reflux valve such that when the feed stream flow rate is above the feed stream set point, the reflux control valve opening decreases to in turn decrease the reflux flow rate of the argon-rich liquid reflux stream and thereby cause the argon-rich liquid to back up into the condensation passages, an increase in pressure of the argon-rich vapor stream within the argon column and a decrease in the feed flow rate of the crude argon feed stream. When the feed stream flow rate is below the feed stream set point, the reflux control valve opening increases to in turn increase the reflux flow rate of the argon-rich liquid reflux stream and thereby cause a decrease in the pressure of the argon-rich vapor stream within the argon column and an increase in the feed flow rate of the crude argon feed stream. Where temperature is sensed, preferably a temperature controller is responsive to the temperature transducers and configured to generate control valve signals to control the opening of the reflux control valves such that the feed stream flow rate decreases when the temperatures of the partially vaporized crude liquid oxygen streams are above a predetermined level indicative of dry out within the vaporization passages. In this regard, the crude argon flow controller also generates control valve signals to control the opening of the reflux control valve. A low select connected to the temperature controller and the crude argon flow controller passes the control valve signals generated by either the temperature controller or the crude argon flow controller of lower amplitude. As mentioned previously, the crude liquid oxygen flow controllers can also be responsive to the temperature transducers such that when the temperatures are unequal, the flow rate set points are biased so as to maintain the temperatures at an equal level.

The control subsystem for controlling the product flow rate can comprise a product flow control valve connected to a product outlet of the argon columns and a product flow transducer connected to the product outlet, upstream of the product flow control valve, to sense the product stream flow rate of the argon-rich product stream. The product flow transducer is configured to produce a product signal referable to the product stream flow rate and a product flow controller is provided that is responsive to a product flow rate set point and the product signal. The product flow rate set point being a function of feed flow rate of the crude argon stream multiplied by a product fraction. The product flow controller configured to control the product flow control valve and thereby maintain the product stream flow rate at the product flow rate set point.

In another aspect, the present invention provides a method of condensing argon reflux within an air separation unit having an argon column, a lower pressure column and a higher pressure column. In accordance with this aspect of the present invention, argon-rich vapor streams are condensed within condensation passages of a plurality of once-through heat exchangers connected to the argon column such that argon-rich vapor streams composed of argon-rich vapor column overhead are condensed within condensation passages of the once-through heat exchangers to produce an argon-rich liquid product stream and argon-rich liquid reflux stream returned to the argon column as reflux. The argon-rich vapor column overhead is produced through distillation of a crude argon feed stream fed from the lower pressure column to the argon column. A plurality of crude liquid oxygen streams, composed of a crude liquid oxygen column bottoms of the higher pressure column, are introduced into vaporization passages of the plurality of once-through heat exchangers to partially vaporize the crude liquid oxygen streams through indirect heat exchange with the argon-rich vapor streams to produce partially vaporized crude liquid oxygen streams introduced into the lower pressure column. Liquid flow rates of the crude liquid oxygen streams are sensed at locations within the air separation plant where the crude liquid oxygen streams are in a liquid state and the liquid flow rates are controlled, such that the liquid flow rates of the crude liquid oxygen streams are in proportion to vaporization surface areas provided by the vaporization passages of each of the one-through heat exchangers. A feed stream flow rate of the crude argon feed stream is controlled in response to an air flow rate into the air separation unit and a product flow rate of the argon-rich liquid product stream is controlled in response to the feed stream flow rate of the crude argon feed stream.

Again, the vaporization surface areas provided by the vaporization passages of each of the once-through heat exchangers can be of equal size. The level of the crude liquid oxygen column bottoms in the higher pressure column can be sensed and the liquid flow rates can be controlled such that the flow rate set points decrease as the level of the crude liquid oxygen bottoms decreases and vice-versa and the level is maintained at a constant height within the higher pressure column. Temperatures of the partially vaporized crude liquid oxygen streams can be sensed that are indicative of quality of the partially vaporized crude liquid oxygen streams. In response to the temperatures, the feed stream flow rate and the product flow rate are controlled such that feed stream flow rate decreases when the temperatures of the partially vaporized crude liquid oxygen streams are above a predetermined level indicative of dry out within the vaporization passages. Further, when the temperatures are unequal, the liquid flow rates can be biased so as to maintain the temperatures at an equal level.

Preferably, the feed stream flow rate of the crude argon feed stream can be controlled in response to an air flow rate into the air separation unit by controlling the reflux flow rate of the argon-rich liquid reflux such that when the feed stream flow rate is above a feed stream set point, given by a function of the air flow rate into the air separation unit multiplied by a crude fraction, the reflux flow rate of the argon-rich liquid reflux stream is decreased. The decrease thereby causes the argon-rich liquid to back up into the condensation passages, an increase in pressure of the argon-rich vapor stream and within the argon column and a decrease in the feed flow rate of the crude argon feed stream. When the feed stream flow rate is below the feed stream set point, the reflux flow rate of the argon-rich liquid reflux stream is increased to thereby cause a decrease in the pressure of the argon-rich vapor stream and within the argon column and an increase in the feed flow rate of the crude argon feed stream. In response to temperatures of the partially vaporized crude liquid oxygen streams that are sensed, the reflux flow rate of the argon reflux stream can also controlled to in turn decrease the feed flow rate of the crude argon feed stream by causing the argon-rich liquid to back up into the condensation passages and an increase in pressure of the argon-rich vapor stream and within the argon column when the temperatures of the partially vaporized crude liquid oxygen streams are above a predetermined level indicative of dry out within the vaporization passages. Also, as mentioned above, when the temperatures are unequal, the liquid flow rates are biased so as to maintain the temperatures at an equal level.

The control of the product stream flow rate can be effectuated by sensing the product stream flow rate of the argon-rich product and controlling the product stream flow rate to maintain the product stream flow rate at a product flow rate set point. The product flow rate set point being a function of feed flow rate of the crude argon stream multiplied by a product fraction.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
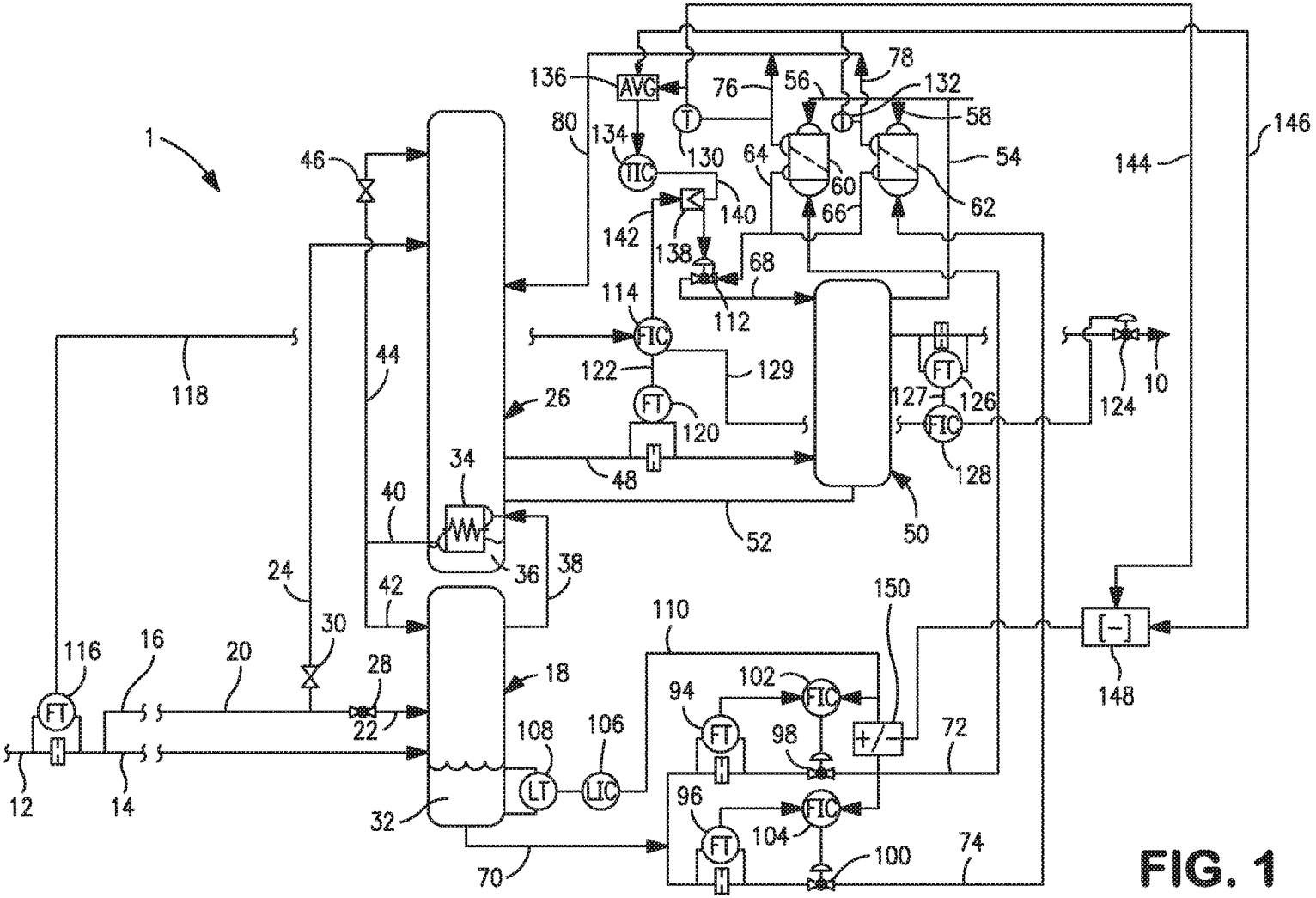
FIG. 1 is a fragmentary, process flow diagram illustrating the physical controls used in a cryogenic air separation plant carrying out a method in accordance with the present invention.

With reference to FIG. 1, a cryogenic air separation plant 1 is illustrated that is designed to rectify air and to produce an argon product stream 10. Although not illustrated, the incoming air is compressed and then purified in purification unit employing beds of adsorbent to adsorb higher boiling impurities such as carbon dioxide and water vapor. The compression and purification produces a compressed and purified air stream 12 that is cooled and then introduced into a distillation column system that, as will be further discussed, has a higher pressure column 18 linked to a lower pressure column 26 in a heat transfer relationship and an argon column 50 that separates oxygen from argon in an oxygen and argon vapor stream discharged from the lower pressure column to produce the argon product stream 10.

Compressed and purified air stream 12 is divided into subsidiary compressed and purified air streams 14 and 16, respectively. Again, although not illustrated, the first subsidiary compressed and purified air stream 14 is cooled to a temperature suitable for its distillation and is then introduced into a higher pressure column 18 and the subsidiary air stream 16 is further compressed and the condensed to form a liquid air stream 20. Such liquid air stream 20 could be formed in connection with heating a pressurized liquid stream to produce a product either as a high pressure vapor or a supercritical fluid. However, this is mentioned for illustration only and cryogenic air separation plants where there is no liquid air is produced are possible. It is further understood that the cooling of the air would take place in a heat exchanger sometimes referred to as a main heat exchanger which could be a series of heat exchangers operated in parallel. In the illustrated embodiment, the liquid air stream is divided into first and second subsidiary air streams 22 and 24 which are introduced into the higher pressure column 18 and a lower pressure column 26, respectively. Expansion valves 28 and 30 are provided to reduce the pressure of the first and second subsidiary air streams 22 and 24 to pressures suitable for their entry into the higher and lower pressure column 18 and 26.

The higher and lower pressure columns 18 and 26 and the argon column 50 to be discussed all have mass transfer contacting elements to contact liquid and vapor phases of the mixture to be distilled in each of the columns. These elements can be sieve trays, structured packing or a combination of such trays and structured packing. The, higher pressure column 18 operates at a pressure of 5.0 to 6.0 bar(a) and serves to separate the incoming air into a nitrogen-rich vapor column overhead and a crude liquid oxygen column bottoms 32, also known as kettle liquid. The lower pressure column 26 will typically operate at 1.1 to 1.5 bar (a) and is linked to the higher pressure column 18 in a heat transfer relationship by means of a condenser reboiler 34. The lower pressure column serves to further refine the crude liquid oxygen 32 into an oxygen-rich liquid column bottoms 36 and a nitrogen-rich vapor column overhead. A nitrogen-rich vapor stream 38 composed of the nitrogen-rich vapor column overhead produced in the higher pressure column 18 is condensed in the condenser reboiler to produce a liquid nitrogen stream 40 through indirect heat exchange with the oxygen-rich liquid column bottoms 36, thereby partially vaporizing the column bottoms and initiating formation of the ascending vapor phase within such column. The liquid nitrogen stream 40 is divided into liquid nitrogen reflux streams 42 and 44 that are introduced into the higher and lower pressure columns 18 and 26 as reflux and thereby to initial formation of the descending liquid phase of the mixture to be distilled in each of the columns. An expansion valve 46 is provided to let down the pressure of the liquid nitrogen reflux stream 44 to one that is compatible with the operating pressure of the lower pressure column 26. Although not illustrated, liquid nitrogen reflux stream 44 could be subcooled in a subcooling unit also used in subcooling the crude liquid oxygen column bottoms to be further refined in the lower pressure column 26 and thereby inhibit flash of such liquids into vapor fractions. Also not illustrated are various product streams emanating from the lower pressure column. For example, a nitrogen-rich vapor stream and a liquid oxygen stream could be extracted from the lower pressure column 26 and then introduced into the main heat exchanger used in the cooling of the incoming compressed and purified air. Liquid oxygen could be pumped to deliver an oxygen product at pressure after the same was heated through indirect heat exchange with second compressed and purified air stream 20.

In connection with the production of argon, a crude argon feed stream 48 is removed from the lower pressure column 26 and then introduced into the argon column 50 for rectification. Crude argon feed stream 48 is a vapor stream containing oxygen and argon which are separated within the argon column 50. Such rectification produces an oxygen-rich liquid column bottoms, which is returned to the lower pressure column 26 by means of liquid oxygen stream 52 and an argon-rich vapor column overhead. An argon-rich vapor column overhead stream 54 is divided into two subsidiary argon-rich vapor streams 56 and 58 that are condensed in argon reflux condensers 60 and 62, respectively, to form argon-rich reflux streams 64 and 66. Argon-rich reflux streams 64 and 66 combined to form an argon reflux stream 68 that is returned to the argon column 50 as reflux. The argon product stream 10 is withdrawn from the argon column 50. It is understood, however, that such stream could be formed from part of the argon reflux stream 68.

The condensation of the argon-rich vapor streams 56 and 58 within the argon reflux condensers 60 and 62 is brought about through indirect heat exchange with crude liquid oxygen column bottoms 32. A crude liquid oxygen column bottoms stream 70 is withdrawn from the higher pressure column 18 and divided into crude liquid oxygen streams 72 and 74 which are partially vaporized in the argon reflux condensers in indirect heat exchange with the argon-rich vapor streams 56 and 58. This partial vaporization results in the production of partially vaporized crude liquid oxygen streams 76 and 78 that are combined into a combined partially vaporized crude liquid oxygen stream 80 that is introduced into the lower pressure column 26 for further refinement.

Figure 2:
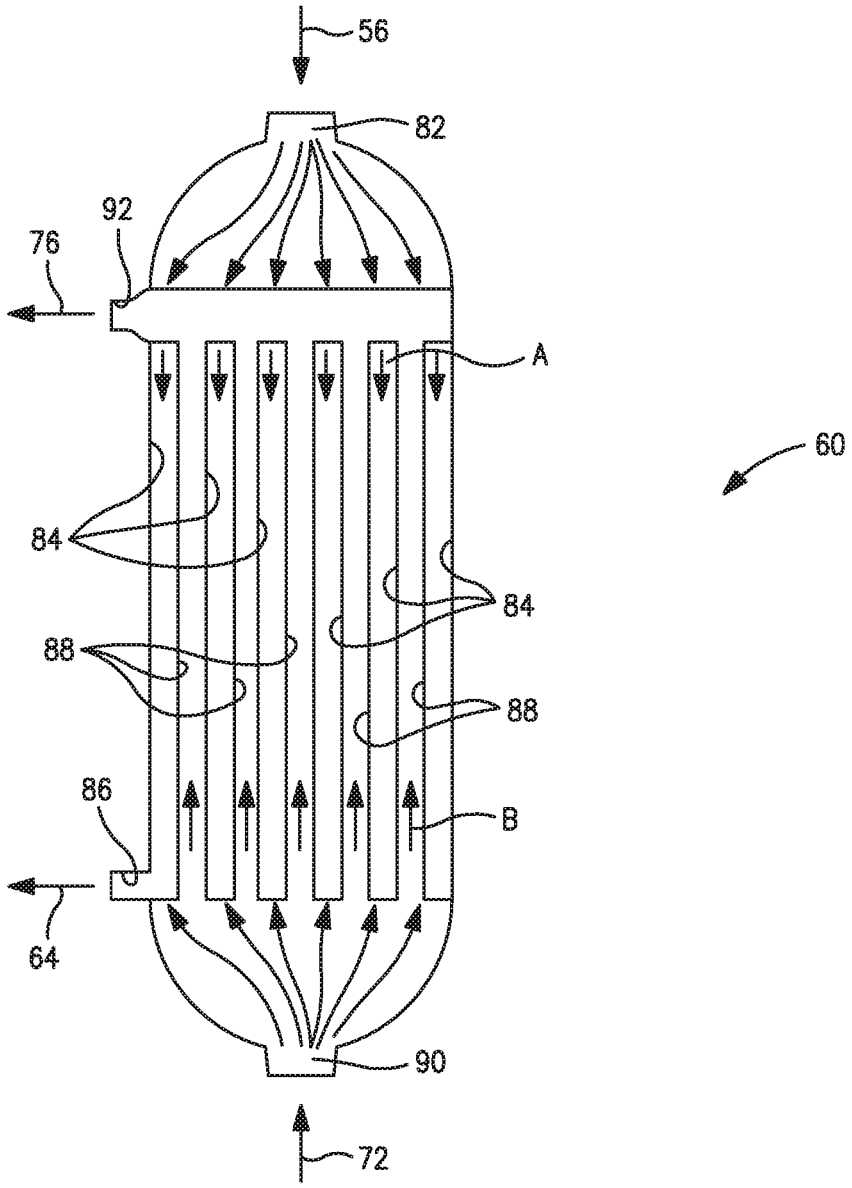
FIG. 2 is a schematic diagram of a once-through heat exchanger used in FIG. 1.

The argon reflux condensers 60 and 62 are of the once-through type and although two of such heat exchangers are illustrated, there could be more than two depending upon the condensation requirements. With reference to FIG. 2, argon reflux condenser 60 is provided with an inlet 82 into which argon-rich vapor stream 56 is introduced. The incoming argon-rich vapor flows downwardly, in the direction of arrowhead "A", into condensation passages 84 and the resulting argon-rich liquid stream 64 is discharged from outlet 86. The crude liquid oxygen stream 72 is introduced into adjacent vaporization passages 88 through an inlet 90 and flows in an upward direction as indicated by arrowhead "B". The indirect heat exchange between the crude liquid oxygen stream 72 and the argon-rich vapor stream 56 results in the partial vaporization thereof and the production of the partially vaporized crude liquid oxygen stream 76 which is discharged from outlet 92. It is understood that argon reflux condenser 62 would be of the same design and function in the same manner with respect to the condensation of the argon-rich vapor stream 58 and the partial vaporization of the crude liquid oxygen stream 74.

With continued reference to FIG. 1, as illustrated, the bottom of the higher pressure column 18 is situated at a sufficient distance below the height of the argon reflux condensers 60 and 62 that the crude liquid oxygen streams 72 and 74 will suffer a loss of head and therefore, pressure by the time the streams reach the argon reflux condensers 60 and 62. As a result of such pressure loss, part of the crude liquid contained in such streams will invariably vaporize. At the same time, since the argon reflux condensers 60 and 62 are identical and have the same heat exchange duty, the crude liquid oxygen bottoms stream 70 has to be divided equally. If this were not done, one of the argon reflux condensers 60 and 62 could suffer dry-out in the vaporization passages 88 leading to the higher boiling hydrocarbons to be deposited within such passages leading to a flammability hazard. It is understood that embodiments of the present invention are possible in which the argon reflux condensers are of different size and the crude liquid oxygen would have to be divided in accordance with the surfaces available for heat exchange provided within vaporization passages 88.

In any case, it becomes highly problematical to accurately divide and control the flow of the crude liquid oxygen streams once vaporization has occurred. In accordance with the present invention, such division and control of the flow occurs where the crude liquid oxygen is in a liquid state rather than one in which the liquid has partially vaporized. This is accomplished by sensing liquid flow rates of the crude liquid oxygen streams 72 and 74 by means of flow transducers 94 and 96, respectively. Flow transducers 94 and 96 are situated within crude liquid oxygen feed conduits at locations thereof where the crude liquid oxygen streams 72 and 74 are in a liquid state to enable the accurate measurement of flow. Flow control valves 98 and 100 are positioned within such crude liquid oxygen feed conduits, downstream of the flow transducers 94 and 96, to control the liquid flow rates. The operation of flow control valves 98 and 100 are controlled by flow controllers 102 and 104, respectively. Flow controllers 102 and 104 are preferably proportional, integral, differential controllers that respond to flow signals generated by the flow transducers 94 and 96 that are referable to the liquid flow rates of the crude liquid oxygen streams 72 and 74 within their associated crude liquid oxygen feed conduits. The flow controllers 102 and 104 respond by controlling the opening of the flow control valves 98 and 100 to maintain flow rate set points which are proportional to vaporization surface areas provided by the vaporization passages 88 of the once through heat exchangers 60 and 62. Thus, if the vaporization surface areas were equal because the once-through heat exchangers 60 and 62 are of equal size, then presumptively, the flow rate set points would be equal to provide equal flows. However, the flows are not exactly equal at all times in that a slight bias may be imparted to the flow rates in a manner that will be discussed. The flow rate set points are preferably generated by a level controller 106 that is responsive to a level transducer 108 that is in turn connected to the higher pressure column 18 to sense the level of the crude liquid oxygen bottoms 32 and generate a level signal referable to the level. The level controller 106 in turn generates the flow rate set points based upon the sensed level. For example, as the level of the crude liquid oxygen column bottoms 32 decreases the set points also have to decrease to allow the level to be maintained at a level set point of constant height for crude liquid oxygen column bottoms 32. The flow rate set points are in turn transmitted to the flow controllers 102 and 104 by means of an electrical connection or a wireless connection shown by line 110.

As can be appreciated, the height separating the once-through heat exchangers 60 and 62 and the bottom of the higher pressure column 18 will result in a loss of head along with pressure of the crude liquid oxygen streams 72 and 74. Also, there will be a pressure drop through the once-through heat exchangers 60 and 62, across valves 98 and 100 and other associated equipment. The result of the loss of pressure will cause vaporization of the liquid within crude liquid oxygen streams 72 and 74. While this loss in pressure is necessary to enable the combined partially vaporized crude liquid oxygen stream 80 to be introduced into the lower pressure column 26 at a compatible pressure that will not result in an evolution of vapor within the lower pressure column 26 that would hurt recovery, the degree of vaporization of the crude liquid oxygen streams just prior to their entry into the once-through heat exchangers 60 and 62 should be limited to less than 20.0 percent, preferably less than 10.0 percent so that dry out can be prevented within the vaporization passages 88 thereof. The degree of vaporization can be controlled somewhat by proper design of piping, valves and etc. and such control may be sufficient form many applications of the present invention. However, such vaporization can also be minimized by subcooling the crude liquid oxygen within a subcooling heat exchanger positioned between the higher pressure column 18 and the branching out of the crude liquid oxygen conduits carrying crude liquid oxygen streams 72 and 74. Typically, such a heat exchanger will accomplish such subcooling through indirect heat exchange with a nitrogen-rich vapor stream produced from column overhead in the lower pressure column 26. It is to be noted here that although the crude liquid oxygen streams 72 and 74 are illustrated as branching from a single line, the associated crude liquid oxygen conduits could be direct connected to the higher pressure column 18 and if a subcooling heat exchanger were used, it would need two sets of passages for such purposes.

A feed stream flow rate of the crude argon feed stream 48 to the argon column 50 is preferably controlled, albeit indirectly, by means of an argon reflux control valve 112 that directly controls the flow of argon-rich liquid reflux stream 68 to argon column 50. As a reflux flow rate of the argon-rich liquid reflux stream 68 is successively decreased by closing argon reflux control valve 112, the argon-rich liquid will back up into the condensation passages 84 and thereby cause an increase in pressure of the argon-rich vapor column overhead stream 54 and thus, within the argon column 50. The increase in pressure will thereupon cause a decrease in the feed flow rate of the crude argon feed stream 48. Of course by opening the argon reflux valve 112, the reflux flow rate of the of the argon-rich liquid reflux stream 68, a decrease in pressure within the argon-rich vapor column overhead stream 54 and thus, within the argon column 50 to increase in the feed flow rate of the crude argon feed stream 48. Alternative control systems and methods could be direct control, namely, the control of crude argon feed stream 48 by a valve positioned between the argon column 50 and the lower pressure column 26.

While the control of argon reflux control valve 112 could be through manual intervention by monitoring flow and making remote adjustments, preferably the control of the argon reflux control valve 112 is accomplished with a flow controller 114 that is responsive to the flow rate of the compressed and purified air stream 12. A flow rate of the incoming compressed and purified air stream 12 is sensed by a flow transducer 116 that generates an air stream signal referable to the flow rate of the compressed and purified air stream 12 and transmitted to the flow controller 114 by means of an electrical or wireless connection 118. Additionally, a feed flow transducer 120 is connected to a crude argon feed conduit in which the crude argon feed stream 48 flow to sense the feed stream flow rate and thereby to produce a crude argon signal referable to the feed stream flow rate of the crude argon feed stream 48 which is transmitted to the flow controller 114 by means of an electrical or wireless connection 122. The crude argon flow controller 114 on the basis of the flow rate of the compressed and purified air stream 12 as measured by flow transducer 116 calculates a feed stream set point that is equal to the flow rate multiplied by a crude fraction. The crude fraction is the fraction of argon contained in the crude argon feed stream 48 on a mass basis that is contemplated for the operation of the argon column 50. The feed stream flow rate, as measured by the feed flow transducer 120, is then compared to the feed stream set point and if greater than the set point, the flow controller 114 then reduces the opening of the argon reflux control valve 112. If the feed stream flow rate is less than the set point, the reverse occurs and the flow controller 114 acts to increase the opening of the argon reflux control valve 112.

The flow rate of the argon product stream 10 is controlled by a product flow control valve 124 connected to a product outlet of the argon column 50. Again, although such control valve 124 could be manually controlled, preferably the control is automatic. To such end, a product flow transducer 126 is also connected to the product outlet, upstream of the product flow control valve 124, to sense the product stream flow rate of the argon-rich product stream. The product flow transducer 126 transmits a product signal referable to the product stream flow rate to a product flow controller 128. Product flow controller 128 is connected to the product flow transducer 126 by means of an electrical or wireless connection 130 and also to the feed flow transducer 120 by means of an electrical or wireless connection 132. The product flow controller 128 calculates a product flow set point that is a product of the feed stream flow rate of the crude argon feed stream 48 and a product fraction. The product fraction is the fraction of argon that is calculated to be contained in the argon product stream 10 based upon the flow rate of the crude argon stream 48. The product flow rate as sensed by the product flow transducer 126 is then compared to the product flow set point. If the product flow rate is below the product flow set point, the product flow controller 128 operates to move the product flow control valve 124 to a more open position to increase the flow. If the product flow rate is above the product flow set point, the product flow controller 128 operates to move the product flow control valve 124 towards a closed position to decrease the flow. It is to be noted that the argon product stream 10 is illustrated as being taken from below the top of the argon column 50. The purpose of this is to remove nitrogen from the argon liquid that is drawn off as a product. It is understood that the invention is equally applicable to a system in which the argon liquid is drawn from the condensate that partially serves as reflux to the argon column 50.

As has been mentioned above, the quality of the crude liquid oxygen streams 72 and 74 with respect to their vapor content at their point of entry into the once-though heat exchangers 60 and 62 is important to prevent dry-out operational conditions within the heat exchangers. While the quality of the crude liquid oxygen streams 72 and 74 is largely dependent upon piping and valve design, transient operational conditions of the air separation plant 1 can also possibly have an effect on the quality, or in other words the vapor content of the crude liquid oxygen streams 72 and 74. For example, transient condition occasioned by turning the air separation plant 1 down might produce an increase in such vapor content. In order to further guard against this, temperature transducers 130 and 132 can optionally be provided to sense temperatures of the partially vaporized crude liquid oxygen streams 76 and 78, respectively. These temperatures are indicative of quality of the partially vaporized crude liquid oxygen streams because as the vapor content of such streams rise, the temperature of the streams will rise as well. The temperature transducers 130 and 132 can be connected to a temperature controller 134 by means of electrical or wireless connections. The signals referable to the temperatures can be introduced into programming associated with the temperature controller 134 that will function to average the signals and produce an average temperature. This programming is indicated by reference number 136 and block "AVG". The temperature controller is programmed to control valve 112 to move the control valve 112 toward a closed position and reduce the feed stream flow rate of the crude argon feed stream 48 and therefore the product flow rate of the product stream 10 when the average temperature is above a predetermined level indicative of dry out within the vaporization passages. Both the temperature controller 134 and the flow controller 114 are connected to a low select 138 by means of electrical or wireless connections 140 and 142, respectively, so that the lower of the valve openings as computed by the flow controller 114 and the temperature controller 134 are selected to control the position of the control valve 112.

As can be appreciated, simplified systems could be used in which only one temperature were sensed of one of the partially vaporized crude liquid oxygen streams 76 or 78; and such temperature could be used as indicative of the quality of both streams. However, the sensing of the temperatures of both of such streams is advantageous in that is can be used to slightly vary the flow rate of the crude liquid oxygen streams 72 and 74 where the temperatures are unequal and potentially the flow rates of the streams are unequal due to slight differences in piping geometry. This is done through programming associated with one of the flow controllers, for example, flow controller 104. The two temperature signals generated by temperature transducers 130 and 132 are transmitted by means of electrical or wireless connections 144 and 146 to programming designated by reference number 148 as "[−]" that functions to subtract the signals and obtain a difference referable to the difference in temperatures. This difference is fed to other programming indicated by reference number 150 and "±" that will modify the set point sent to flow controller 104 by either decreasing or increasing the set point to thereby increase or decrease the flow of crude liquid oxygen stream 74. For instance, if the temperature of crude liquid oxygen stream 78 is greater than that of crude liquid oxygen stream 76, more vapor is present in the crude liquid oxygen stream indicating that the flow of crude liquid oxygen stream 78 should be biased with a slight increase over the flow of crude liquid oxygen stream 76. And an increase in the set point associated with the flow controller 104 will have such effect in that the total flow of the crude liquid oxygen column bottoms is fixed.

While the present invention has been described with reference to a preferred embodiment, as will occur to those skilled in the art, numerous changes and omissions can be made without departing from the spirit and scope of the present invention as set forth in the appended claims.

What is claimed is:

1. A method of condensing argon reflux within an air separation unit having an argon column, a lower pressure column and a higher pressure column, said method comprising the steps of:

extracting a crude argon feed stream from the lower pressure column;

distilling the crude argon feed stream in the argon column to produce an argon-rich vapor column overhead;

directing at least a portion of the argon-rich vapor column overhead to a plurality of once-through heat exchangers;

condensing the argon-rich vapor streams within condensation passages of the plurality of once-through heat exchangers such that argon-rich vapor streams composed of argon-rich vapor column overhead are condensed within condensation passages of the once-through heat exchangers to produce an argon-rich liquid product stream and argon-rich liquid reflux stream returning the argon-rich liquid reflux stream to the argon column as reflux;

introducing one or more streams of crude liquid oxygen column bottoms from the higher pressure column into vaporization passages of the plurality of once-through heat exchangers to partially vaporize the crude liquid oxygen streams through indirect heat exchange with the argon-rich vapor streams to produce partially vaporized crude liquid oxygen streams introducing the partially vaporized crude liquid oxygen streams into the lower pressure column;

sensing liquid flow rates of the crude liquid oxygen streams directed from the bottom of the higher pressure column to the vaporization passages of the plurality of once-through heat exchangers;

controlling the flow rates of the crude liquid oxygen streams to the plurality of once-through heat exchangers in response to the sensed liquid flow rates and the level of the crude liquid oxygen bottoms in the higher pressure column; and controlling a feed stream flow rate of the crude argon feed stream in response to an air flow rate into the air separation unit and by controlling the reflux flow rate of the argon-rich liquid reflux by:

(i) decreasing the reflux flow rate of the argon-rich liquid reflux stream when the feed stream flow rate is above a feed stream set point to thereby cause the argon-rich liquid reflux to back up into the condensation passages of the once-through heat exchanger causing an increase in pressure of the argon-rich vapor stream and within the argon column; and (ii) increasing the reflux flow rate of the argon-rich liquid reflux stream when the feed stream flow rate is below a feed stream set point to thereby cause a decrease in the pressure of the argon-rich vapor stream and within the argon column.

2. The method of claim 1 further comprising the step of controlling a product flow rate of the argon-rich liquid product stream in response to the feed stream flow rate of the crude argon feed stream.

3. The method of claim 1 wherein the step of controlling the flow rates of the crude liquid oxygen streams further comprises:

controlling the flow rates of the crude liquid oxygen streams to the plurality of once-through heat exchangers via one or more flow control valves; and adjusting the flow control valves to attain a flow rate set points that are based on the sensed liquid flow rates and the level of the crude liquid oxygen bottoms in the higher pressure column; wherein the flow rate set points are decreased as the level of the crude liquid oxygen bottoms in the higher pressure column decreases and the flow rate set points are increased as the level of the crude liquid oxygen bottoms in the higher pressure column increase.

4. The method of claim 2 wherein the feed stream set point is a function of the air flow rate into the air separation unit multiplied by a crude fraction.

5. The method of claim 2 further comprising the steps of:

measuring temperatures of the partially vaporized crude liquid oxygen streams; and further controlling the feed stream flow rate of the crude argon feed stream and the argon-rich liquid product stream product flow rate in response to the measured temperatures of the partially vaporized crude liquid oxygen streams, wherein the feed stream flow rate of the crude argon feed stream decreases when the temperatures of the partially vaporized crude liquid oxygen streams are above a predetermined temperature indicative of dry out conditions within the vaporization passages.

6. The method of claim 2 further comprising the steps of:

measuring temperatures of the partially vaporized crude liquid oxygen streams; and controlling the reflux flow rate of the argon reflux stream in response to the measured temperatures of the partially vaporized crude liquid oxygen streams, wherein the reflux flow rate of the argon reflux stream is decreased causing the argon-rich liquid to back up into the condensation passages and further causing an increase in pressure of the argon-rich vapor stream and within the argon column when the temperatures of the partially vaporized crude liquid oxygen streams are above a predetermined temperature indicative of dry out conditions within the vaporization passages.

7. The method of claim 2 further comprising the steps of:

measuring the flow rate of the argon-rich liquid product stream;

further controlling the flow rate of the argon-rich liquid product stream via one or more product flow control valves to maintain the flow rate of the argon-rich liquid product stream at a product flow rate set point;

wherein the product flow rate set point being a function of the feed stream flow rate of the crude argon feed stream multiplied by a product fraction.

* * * * *